US006021968A

United States Patent [19]

Brundiek et al.

[11] Patent Number: 6,021,968

[45] Date of Patent: Feb. 8, 2000

[54] ROLLER MILL

[75] Inventors: Horst Brundiek, Kaarst; Armin Neises, Willich, both of Germany

[73] Assignee: Loesche GmbH, Duesseldorf, Germany

[21] Appl. No.: 09/125,004

[22] PCT Filed: Dec. 12, 1996

[86] PCT No.: PCT/EP96/05574

§ 371 Date: Jul. 31, 1998

§ 102(e) Date: Jul. 31, 1998

[87] PCT Pub. No.: WO97/27943

PCT Pub. Date: Aug. 7, 1997

[30] Foreign Application Priority Data

Feb. 1, 1996 [DE] Germany ..... 196 03 655

[51] Int. Cl.[7] ..... B02C 15/04

[52] U.S. Cl. ..... 241/121; 241/285.1

[58] Field of Search ..... 241/117–121, 285.1

[56] References Cited

FOREIGN PATENT DOCUMENTS 153958 8/1904 Germany .

2128929 1/1973 Germany .

*Primary Examiner*—Mark Rosenbaum

*Attorney, Agent, or Firm*—Thelen Reid & Priest, LLP

[57] ABSTRACT

The invention relates to a roller mill, particularly a modular air-swept mill, with a rotary grinding pan on which roll grinding rollers and having columns, on which are mounted by means of rockers the grinding rollers, the columns being in each case fixed to a foundation frame and arranged as a mill foundation frame. For the use of stable and torsionally stiff columns for relatively large roller mills, according to the invention the foundation frames of the columns, together with the connecting frame parts are arranged in a mill foundation to form a circumferential foundation frame, particularly a polygonal or U-shaped frame. A gear foundation frame is located in the mill center separately from the circumferential frame and permits the construction of a different level of the particular areas of the mill foundation.

21 Claims, 6 Drawing Sheets

ROLLER MILL

The invention relates to a roller mill, particularly an air-swept mill having a modular construction.

Modular roller mills are relatively large mills with two, three, four or more grinding rollers rolling on a rotating grinding pan. In such modular roller mills use is made of a force unit as module comprising a column with a rocker bearing, rocker, complete grinding roller, rocker seal with respect to a mill casing and a spring suspension unit formed by a spring suspension cylinder with hydraulic accumulators and which force unit can be associated twice with a relatively small grinding pan, thrice with a medium-sized grinding pan and four or more times with a large grinding pan. The modular construction permits adaptation to the particular requirements without any separate constructional expenditure.

Figure 1:
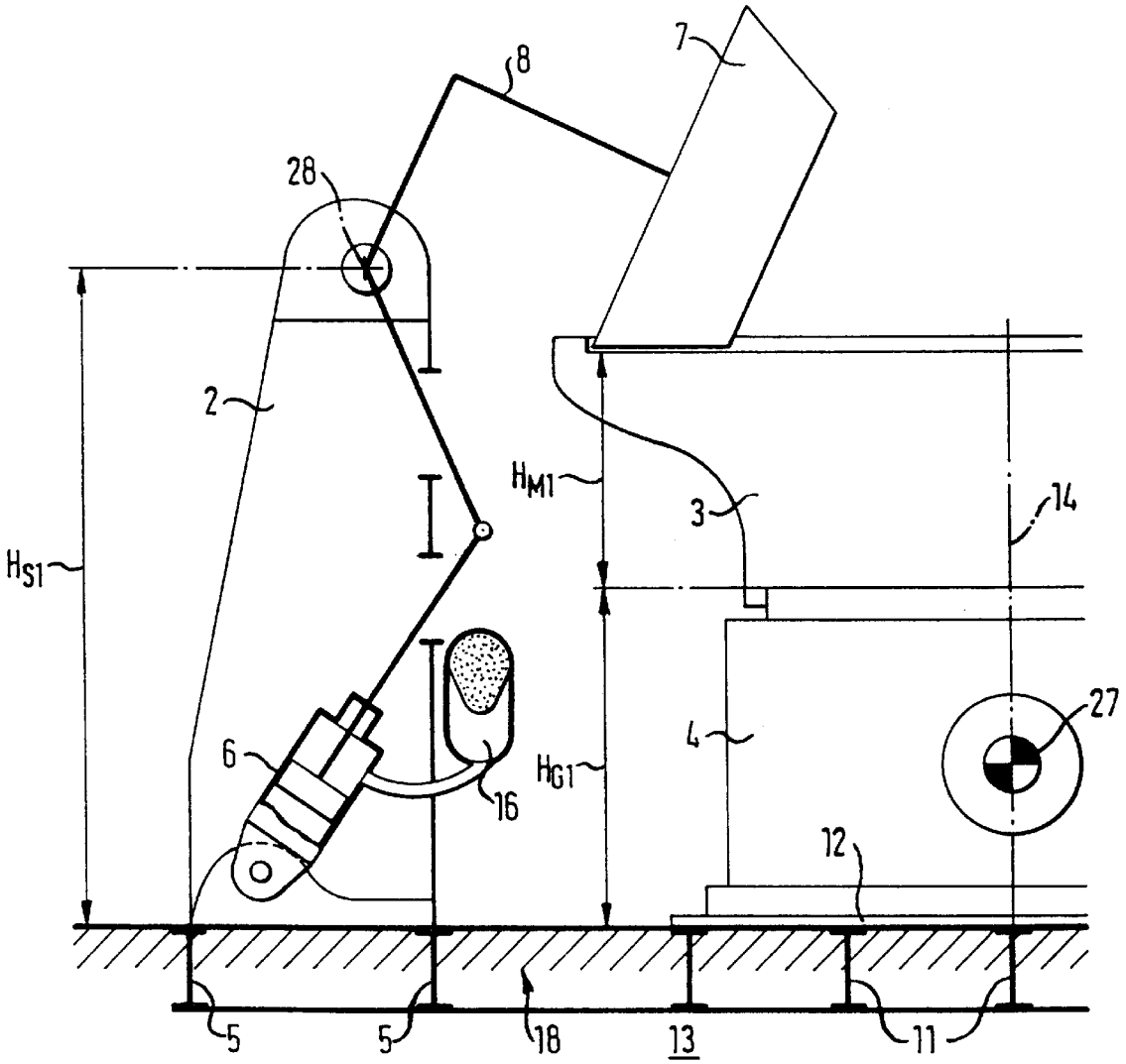
FIG. 1 PRIOR ART

FIG. 1 shows in detail a known modular roller mill in side view and without a casing. The grinding rollers 7, which are pivotably mounted in each case with a rocker 8 about a rocker axis 28 of a column 2, roll on a grinding pan 3 driven by means of a driving shaft 27 via a gear 4.

It is a roller mill with two or more grinding rollers, whereof only one grinding roller 7 is visible. Furthermore a rocker unit constituted by a rocker cylinder 6 and a hydraulic accumulator or a gas spring 16 is shown. The columns 2, which are in each case associated with a grinding roller 7, are fixed at their lower end in the vicinity of a mill foundation 13, which is generally a concrete foundation, to a steel foundation frame 5, e.g. by screwing and/or welding.

The known roller mills have in each case one foundation frame 5 per column 2, which is oriented towards a mill centre defined by a longitudinal axis 14 of the roller mill. In the case of a roller mill with two grinding rollers 7 as a result of the extension of the foundation frame 5 of the two diametrically positioned columns 2, a mill foundation frame 18 is obtained connected by the foundation frame 5 of a column 2 to a gear foundation frame 11 in the mill centre and extending through to the foundation frame 5 of the other column 2 and generally the mill gear 4 is anchored by means of an intermediate plate or a gear sole plate 12 to the gear foundation frame 11 and the through mill foundation frame 18.

In the case of a roller mill with three and more than four grinding rollers, a star-shaped mill foundation frame 18 is obtained. Such a star-shaped mill foundation frame 18 is shown in a diagrammatic view in FIG. 3, which is described hereinafter with reference to the solution according to the invention.

In the case of a roller mill with four grinding rollers 7 a cruciform mill foundation frame 18 is obtained, which can be considered as a special form of a star-shaped mill foundation frame.

Although roller mills and in particular air-swept roller mills already have high grinding capacities, limits are placed on a further increase according to the "pantograph principle". This is due to the fact that with larger diameter roller mills and when using more than two grinding rollers with the requisite productive capacity there is also e.g. a rise in the drive power and, apart from the diameter, also the height of the grinding pans must be increased. It is necessary to use a gear with a greater overall height $H_{G2}$ (cf. FIG. 2).

Figure 2:
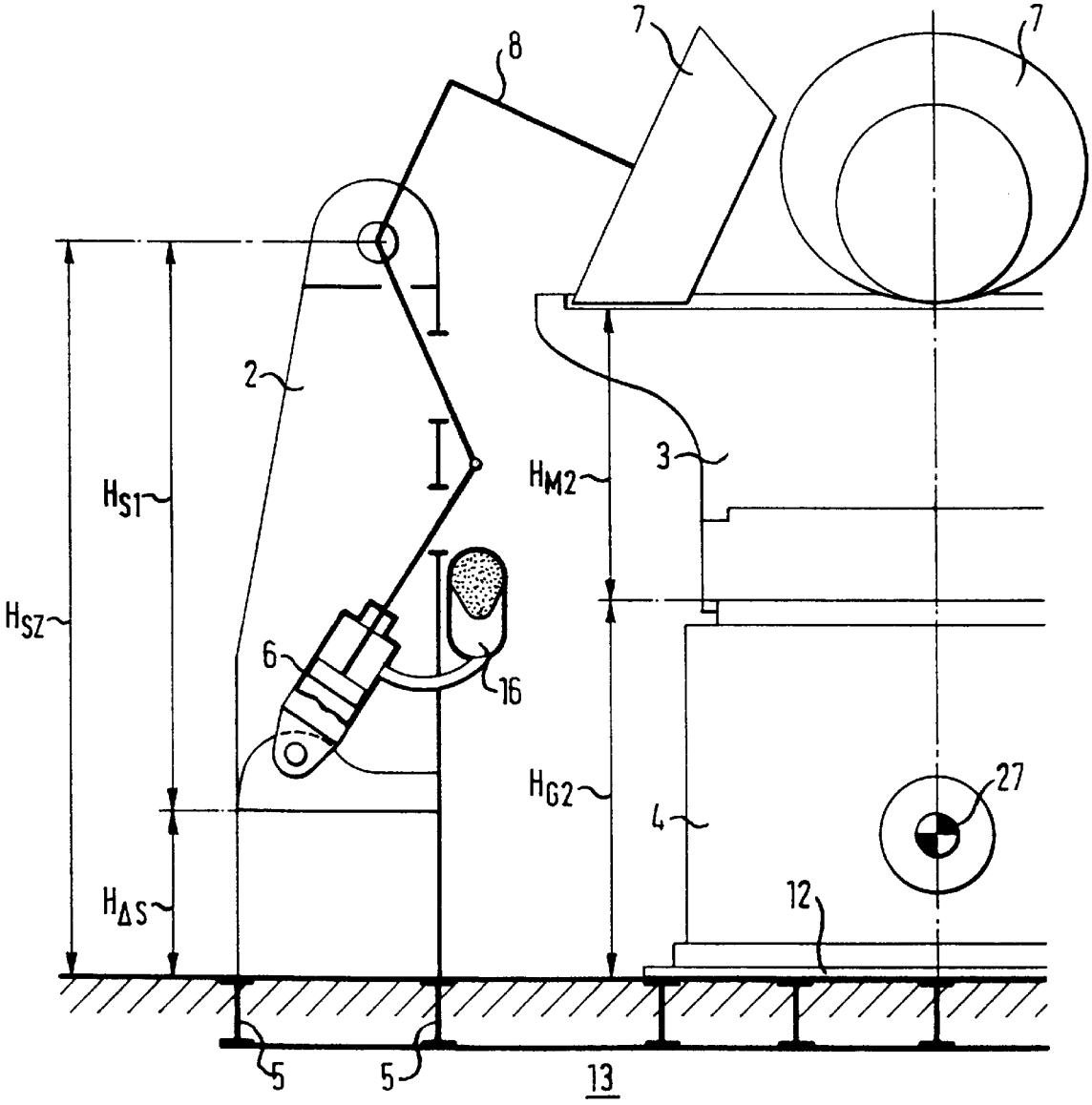
FIG. 2 PRIOR ART

There is also an increase in the overall height $H_{M2}$ of the grinding pan 3 due to the fluid space below it which must be increased, because with air-swept roller mills with increasing productive capacity the volume flows also rise. The overall height $H_{S1}$ of the columns 2 consequently increases by the amount $H_{\Delta S}$ and reaches a height of $H_{S2}$ according to FIG. 2. A comparison of FIGS. 1 and 2 with respect to the overall heights of the gear 4, grinding pans 3 and columns 2 reveals that the increase in the overall height $H_{\Delta S}$ of the column 2 according to FIG. 2 is caused by an overall height increase of the gear 4 and grinding pans 3 of the larger roller mill of FIG. 2.

When using columns having the same cross-section as with relatively small roller mills, e.g. roller mills with two grinding rollers, and a necessarily greater overall height, the stability would be significantly impaired. Thus, due to the bending moments and torsional moments introduced, a greater overall height $H_{S2}$ of the columns 2 has disadvantageous influence on the strength of the columns 2 and the mill foundation frame 18.

Whereas in the case of the hitherto known mill constructions the bending moments introduced into the columns had to be absorbed by means of a foundation frame 18 extended to the mill centre and which reached the gear foundation frame 11 or gear sole plate 12 of the gear 4, this construction did not satisfy the stability and strength reqirements for large mills, because the column length increase necessary as a function of the mill size increase leads to high bending and torsional stresses at the column connections to and in the foundation frame.

The disadvantages of these foundation-side bending and torsional moments with lengthened columns of large mills also occur with roller mills having a so-called "torsionally stiff rim", which is described in German patent 21 28 929. A torsionally stiff unit is only formed in the upper region of the columns, so that the torsional and bending moments can only be introduced into the foundation by means of the column foundation frame. Thus, in said known roller mill construction, a significant enlargement of the roller mills would lead to higher columns and to the associated instabilities and to a deterioration of the operational reliability.

The object of the invention is to provide a roller mill which, when using the known, already used column systems or modules with proven and in particular constant height and whilst ensuring the necessary stability, permits a size increase of the roller mill and, associated with the enlargement of the pan diameter, a particularly pronounced raising of the grinding pan, the gear and consequently the grinding capacity.

According to the invention this object is achieved by the characterizing features of claim 1. Advantageous and appropriate embodiments appear in the subclaims and in the description relative to the drawings.

The invention is based on the fundamental idea of achieving by an appropriate design of the foundation-side frame structure of the columns of a roller mill an adequate stability, even in the case of a necessary overall height increase of the gear and/or grinding pan.

According to the invention, a roller mill with two, three or more grinding roller-column modules has a circumferential foundation frame, which interconnects all the foundation frames of the columns. A particularly torsionally stiff foundation frame is formed by the foundation frame of the individual columns, as well as by connecting frame parts, the connecting frame parts being provided between in each case two adjacent foundation frames of the columns.

A stable and extremely torsionally stiff construction of the columns and foundation frames is ensured by a circumferential, closed and preferably polygonal arrangement of the foundation frames of the columns and the connecting frame parts. In that the foundation or base frame of each column is assembled by means of a connecting frame part or a foundation frame connecting element to a circumferential, closed configuration or connection, or to a U-shaped or horseshoe-shaped connection, torsional and bending moments introduced at the foot of each column into the foundation frame, can be individually or jointly supported.

It is particularly appropriate to have a separate construction of the circumferential column foundation frame and a gear foundation frame. Through such a separation of the circumferential foundation frame and the gear foundation frame, in an extremely advantageous manner the possibility exists of freely choosing independently of one another the level of the circumferential foundation frame of the columns with respect to the level of the foundation frame of the mill gear.

Generally the gear foundation frame is placed in the mill centre, i.e. in the vicinity of the longitudinal axis of the mill. As a function of the overall height, which can be formed from the overall height $H_{M2}$ of the grinding pan and $H_{G2}$ of the gear (FIG. 2), a frame-side foundation arrangement is provided enabling a column of standard overall height and necessary stability and torsional stiffness to be used.

For example, a polygonal frame in the mill foundation of the mill and which surrounds with a clearly defined spacing the gear foundation frame, can be positioned at a different height level with respect to the gear foundation frame. In the case of a mill enlargement with a marked increase in the overall height of the gear and the overall height of the grinding pan, which would lead to a corresponding size increase of the columns, an extremely efficient measure is constituted by a clearly defined and limited foundation raising, namely in the vicinity of the annular, polygonal or U-shaped foundation frame surrounding the gear foundation frame, so as to permit the use of columns having a normal overall height.

Different level areas of a mill foundation are known per se. Thus, German patent 153 958 describes a cone mill with eight grinding cones, whose bearing box is placed on a raised, octagonally formed area of the mill foundation.

In the raised mill foundation are also placed nuts, which cooperate with an adjusting mechanism, in order to set a parallel position of the working surfaces of the grinding cones and the grinding pan. The mill foundation of this known cone mill and the octagonally raised area do not have a foundation frame, which would be necessary for large mills.

The known solution can only be used with small mills, in which there is no need to jointly mutually support the roller units by means of a connecting foundation frame.

Mushroom-shaped mill foundations with a raised area below the mill gear are also known. The arrangement of a foundation frame and in particular a circumferential foundation frame of the columns is not described. As a rule only the mushroom-shaped mill foundation has a foundation frame in the vicinity of the gear, whereas the forces absorbed by the columns are introduced directly and without any steel frame into the mill foundation.

In an appropriate construction, the circumferential foundation frame is located in a concrete rampart higher than the gear foundation frame or a gear sole plate.

It can also be appropriate to place the gear foundation frame on a roughly mushroom-shaped foundation protuberance with respect to the polygonal frame of the columns with a lower level.

Important advantages of the inventive, circumferential foundation frame construction according to the invention are the possibility of separating said annular, polygonal or U-shaped column foundation frame from an in particular centrally positioned gear foundation frame and the bending and torsionally stiff manufacture of a steel girder foundation frame for particularly large roller mills, so that their bending and torsional forces do not have to be introduced into the reinforced concrete only. In place of steel girders it would also be possible to use approximately annular or basketlike arranged reinforcing bars.

As the foundation frame according to the invention reduces to a minimum the overall height of the mill columns, which is predetermined by the rocker and the associated hydropneumatic spring suspension system, there is a limitation to the bending and torsional moments introduced into the mill columns. The consequence is an improved stability and strength of the columns and the roller mill. Further advantages are the possible use of smaller machine tools for the mechanical working due to the lower weight and the reduced overall height, as well as a reduction in manufacturing costs.

An essential advantage results from the possible compensation of the heights of the gear and the pan compared with the height of the columns over the foundation, particularly over a foundation protuberance or mushroom-shaped configuration.

Whereas in the hitherto known solutions for mills with a common mill and gear frame due to the star-shaped or cruciform frame with the same height and through horizontal path, no foundation-side height change was possible, this is possible with a circumferential foundation frame according to the invention and a separate, centrally positioned gear foundation frame.

The invention is described in greater detail hereinafter relative to the attached drawings, wherein show:

FIG. 1 A side view of a known roller mill, without casing.

FIG. 2 A roller mill in the same representation as in FIG. 1, but with a larger overall height of the columns, grinding pans and gear.

Figure 3:
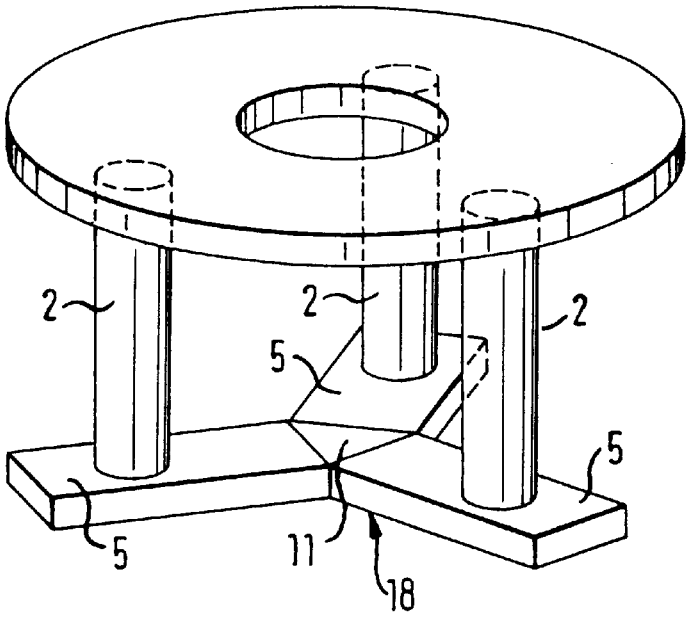
FIG. 3 PRIOR ART

FIG. 3 A diagrammatic representation of a star-shaped foundation frame according to the prior art.

Figure 4:
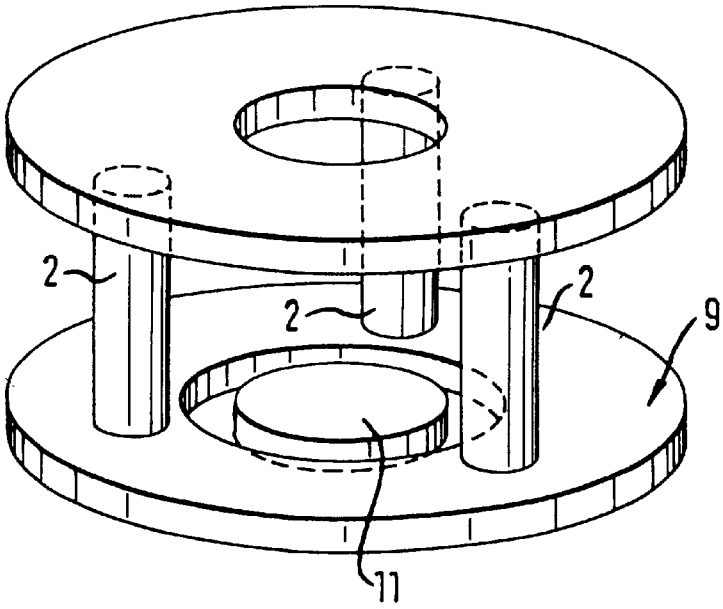

FIG. 4 A diagrammatic representation of the foundation frame construction according to the invention.

Figure 5:
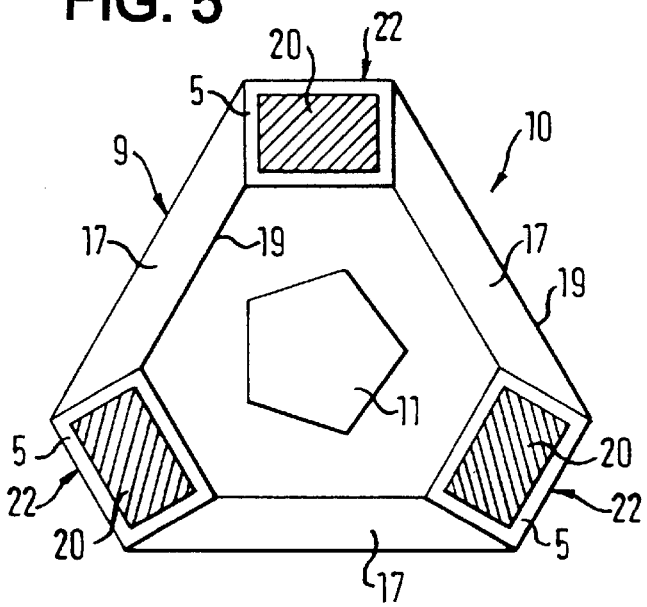
Figure 6:
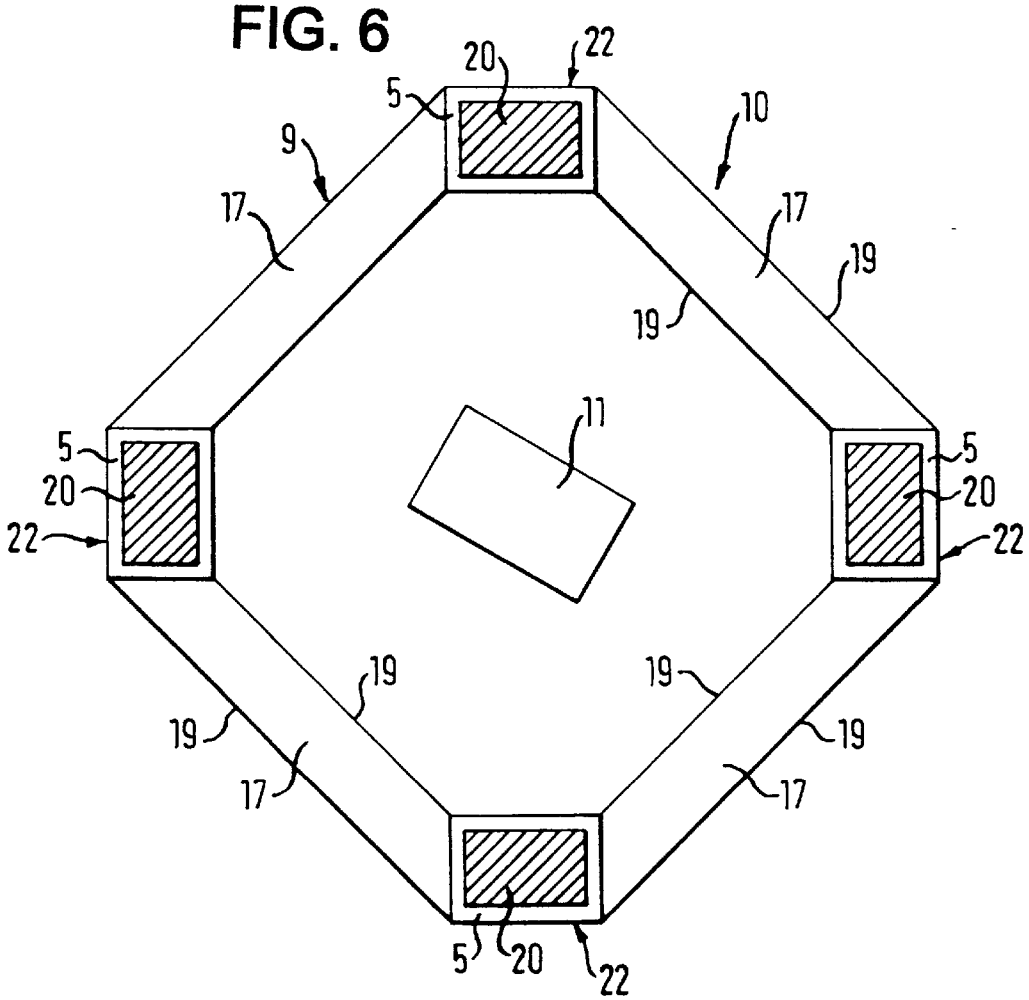

FIGS. 5 and 6 A plan view and diagrammatic representation of a polygonal frame with three or four columns.

Figure 7:
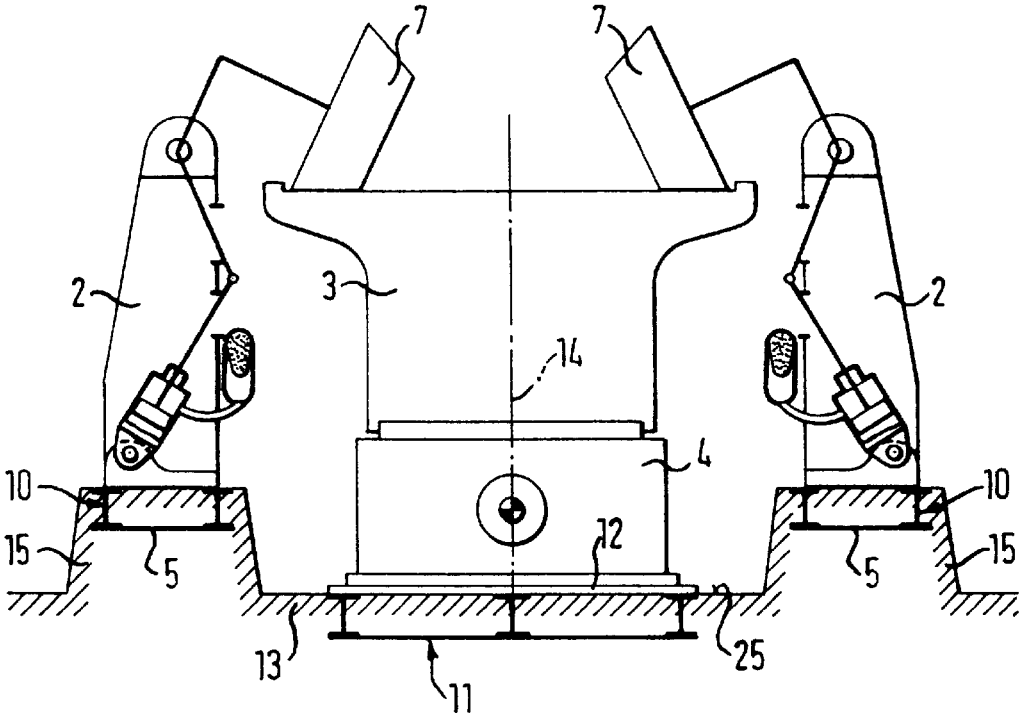

FIG. 7 A roller mill according to the invention without a casing and with a raised mill foundation area for a circumferential foundation frame.

Figure 8:
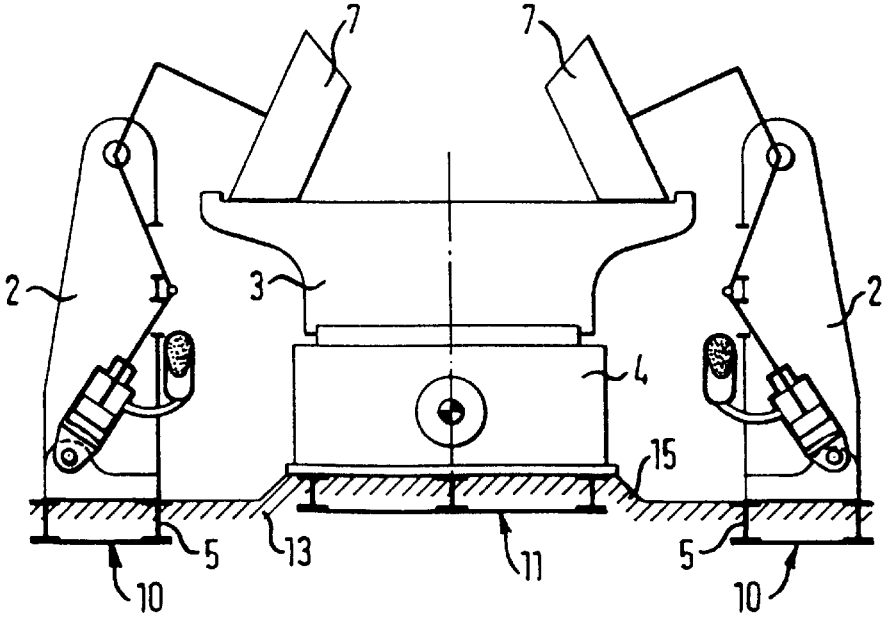
Figure 9:
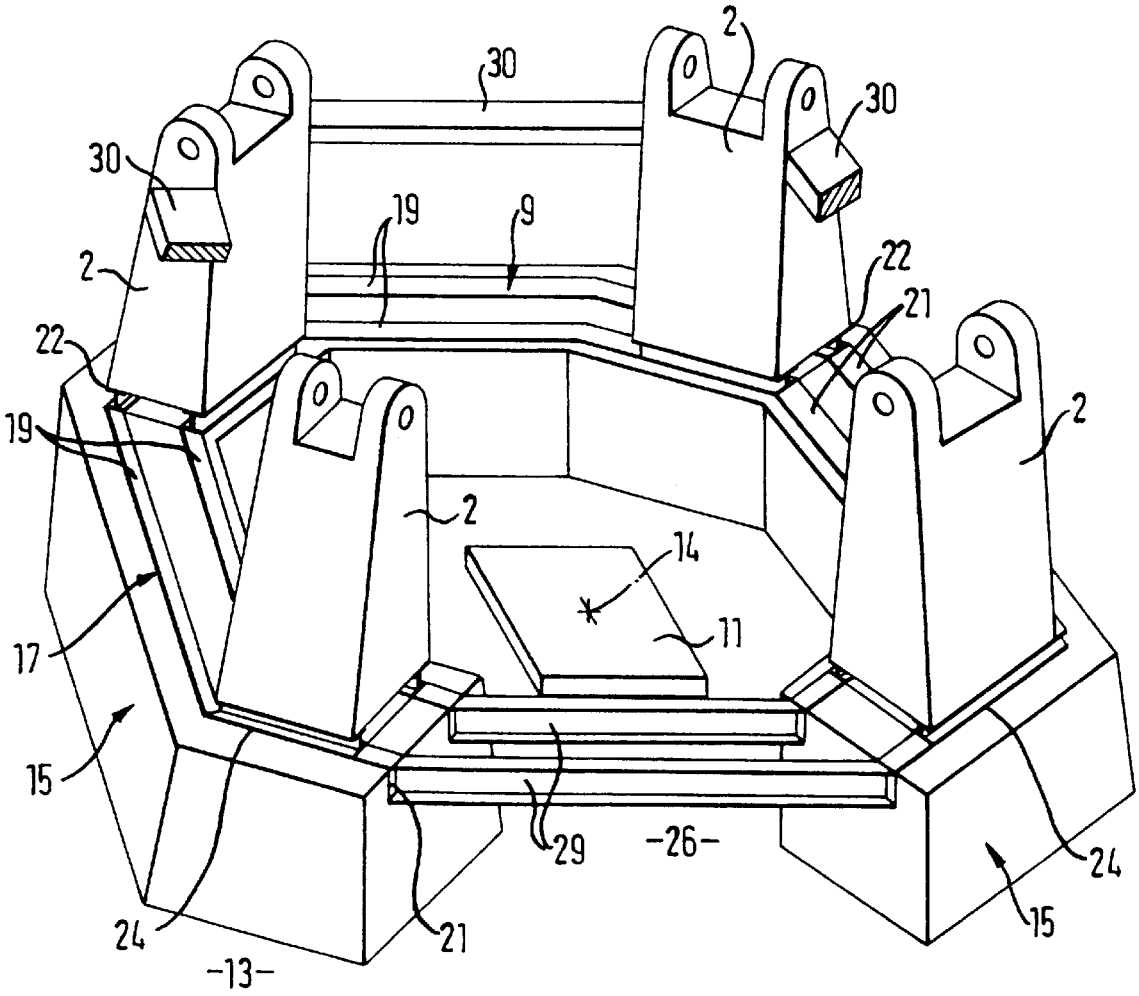

FIG. 8 An alternative representation of a roller mill according to the invention with a mushroom-shaped gear foundation frame and a circumferential foundation frame, and FIG. 9 An alternative representation of a column arrangement with a U-shaped foundation frame in a raised, rampart-like area of a mill foundation.

FIG. 1 is a side view of a known roller mill with two grinding rollers, whereof only one grinding roller 7, as well as a column 2 with rocker axis 28 and rocker 8, as well as a hydropneumatic suspension 6, 16 are shown. At its lower end the column 2 is fixed to a foundation frame 5 of a mill foundation 13. The foundation frame 5 is extended up to the mill centre, i.e. up to a gear foundation frame 11 and forms with the not shown, diametrically positioned foundation frame 5 of the second grinding roller-column unit a through mill foundation frame 18 with a uniform height level.

FIG. 2 shows a roller mill with four grinding rollers, whereof only two grinding rollers 7 and one column 2 with grinding roller 7 are visible. The same features are given the same reference numerals. The four-roller mill according to FIG. 2 illustrates the need for a column extension by the amount $H_{\Delta S}$, so that the columns 2 reach the necessary overall height $H_{S2}$. The need is due to the greater overall height $H_{M2}$ of the grinding pan 3 and the greater overall height $H_{G2}$ of the gear 4 compared with FIG. 1.

A lengthening of a column 2 as shown in FIG. 2 leads to instabilities, so that operational reliability can be impaired.

FIGS. 3 and 4 are intended to illustrate the fundamental means-action connection of the invention. The roller mill according to FIG. 3 which, as is apparent from the columns 2, is intended to be a three-roller mill, has a conventional star-shaped mill foundation frame 18, which is formed by the foundation frame 5 of the columns 2 and a gear foundation frame 11 of a not shown gear. In accordance with the known design solution concept described in conjunction with FIG. 2, the columns 2 have a greater overall height and therefore reduced torsional stiffness and stability compared with the columns 2 of an inventively constructed roller mill according to FIG. 4.

In order to prevent instabilities and so as to permit the use of grinding roller-column modules with particularly known, proven dimensioning in the case of higher capacity roller mills, according to the invention a circumferential foundation frame 9 is provided, which in spaced, frame-like separated manner surrounds a centrally positioned gear foundation frame 11. FIG. 4 shows the inventive separation of the gear foundation frame 11 and circumferential foundation frame 9, which represents a stable column-foundation frame combination. The gear foundation frame 11 and circumferential foundation frame 9 can be arranged independently of one another in mill foundation areas with different heights, so that it is possible to use columns having a known, proven height.

FIG. 5 shows as a plan view a fitted, circumferential foundation frame 9 in the form of a polygonal frame 10 of a roller mill having three grinding rollers. The polygonal frame 10 has three corner areas 22 in which are positioned foundation frames 5. To the foundation frames 5 are fixed by means of their column feet 20 not shown columns and fixing e.g. takes place by screwing. For the construction of a torsionally stiff polygonal frame 10 connecting frame parts 17 are positioned between the individual foundation frames 5, which can e.g. be given a rectangular construction.

In a central arrangement is provided a gear foundation frame 11, which is not connected on the foundation frame side to the polygonal frame 10. This creates the possibility of receiving the polygonal frame 10 and the gear foundation frame 11, corresponding to needs, with a different height level in a mill foundation 13 (cf. FIG. 7 or 8).

As a further development FIG. 6 shows a four-roller mill. In four corner areas 22 are once again located roughly rectangularly constructed foundation frames 5, which are joined by means of connecting frame parts to a polygonal frame 10. The connecting frame parts 17 can comprise steel girders 19, particularly double T-girders placed roughly parallel on a foundation area 13, 15.

FIGS. 7 and 8 show in exemplified manner and in a partial representation roller mills with a polygonal frame 10 of foundation frames 5 of columns 2 and connecting frame parts 17 (not visible), whose height level differs from that of a centrally positioned gear foundation frame 11.

In FIG. 7 the polygonal frame 10 is located in a foundation protuberance 15 constructed as a rampart. The gear foundation frame 11 is much lower in a correspondingly constructed area 25 of the mill foundation 13. For increasing the capacity of the roller mill it is possible to use a larger and higher grinding pan 3 and/or a larger and higher gear 4 and advantageously columns 2 of known, proven size can be used.

FIG. 8 shows a mushroom-shaped mill foundation 13 with a raised level in the area 15 of a gear foundation frame 11.

The same components once again carry the same reference numerals. With columns 2 of the same size it is possible to construct a smaller roller mill in modular manner, in which the grinding pans 3 and gear 4 have a reduced height and therefore there is a raised area 15 of the mill foundation 13 in the vicinity of the gear foundation frame 11.

A further development of a circumferential foundation frame 9 is shown in a perspective view in FIG. 9. A large mill with four grinding rollers (not shown) has as a circumferential foundation frame 9 a U-shaped or horseshoe-shaped frame 21. This U-shaped frame is received in a foundation rampart as a raised area 15 of the mill foundation 13 and comprises two foundation frames 5 of the columns 2 arranged as corner areas 22 and two foundation frames 5 of columns 2 arranged as end areas 24. The U-shaped or horseshoe-shaped construction of the rampart-like, raised area 15 of the mill foundation 13 results from an assembly gap 26 used for assembling the mill gear. The assembly gap 26 forms an interruption to the otherwise closed polygonal frame 10. On the foundation frame side the assembly gap 26 is bounded by two foundation frames 5 of the columns 2 arranged as end areas 24.

A U-shaped foundation frame 21 also leads to high stability, so that not in all cases there is a need for a closed, circumferential foundation frame.

Advantageously a possible weakening of the torsionally stiff foundation frame connection can be compensated by one or more supporting crossbeams 29. These supporting crossbeams 29 can in particular be constructed in the same way as the steel girders of the connecting frame parts 17 and can be detachably and therefore dismantlably connected to the steel girders 23 of the foundation frames 5 of the columns 2. These crossbeams can e.g. be positioned above or below a tubular extension of the drive coupling or clutch between the mill motor and the mill gear (not shown) following an assembly of the gear. By using the supporting crossbeams 29 as a dismantlable connecting frame part, a U-shaped or horseshoeshaped foundation frame 21 can once again be constructed as a closed, circumferential and polygonal foundation frame configuration or connection.

An extremely stable and torsionally stiff construction is obtained if, in addition to the circumferential foundation frame 9, which forms a foundation-side, torsionally stiff connection, in the upper area of the columns 2 is formed a torsionally stiff rim according to German Patent 21 28 929. In FIG. 9 between the columns 2 in the upper area and level with the bearing blocks or rocker axes 28 are shown connecting elements 30, which form with the column areas a so-called "torsionally stiff rim". In that both by a mill foundation frame 9 and at the upper end of the columns 2 a stable construction is formed, a high stability and operational reliability of the thus constructed large mills are ensured.

It is fundamentally possible to provide in place of the steel girders of the circumferential foundation frame 9 and the centrally configurated gear foundation frame 14, correspondingly reinforced concrete areas with steel bars. For example, a reinforced concrete area can have steel bars arranged in basket-like manner.

What is claimed is:

1. A modular air-swept roller mill comprising:

a mill foundation having foundation frames;

connecting frame parts that are provided between the foundation frames so as to connect respective pairs of adjacent foundation frames so as to form a circumferential foundation frame;

columns that are fixed to the foundation frames;

grinding rollers that are mounted on the columns; and a rotary grinding pan on which the grinding rollers are adapted to roll.

2. The roller mill of claim 1, wherein:

the foundation frames and the connecting parts form the circumferential foundation frame as a polygonal foundation frame having corner areas that are the foundation frames.

3. The roller mill of claim 2, wherein:

the circumferential foundation frame surrounds a gear foundation frame that is separate from the circumferential foundation frame and that is positioned at a mill center.

4. The roller mill of claim 1, wherein:

the circumferential foundation frame surrounds a gear foundation frame that is separate from the circumferential foundation frame and that is positioned at a mill center.

5. The roller mill of claim 1, wherein:

the circumferential foundation frame and a gear foundation frame are positioned in areas of the mill foundation at different heights; and columns of uniform height are usable.

6. The roller mill of claim 5, wherein:

the circumferential foundation frame and the gear foundation frame are located at a level of the mill foundation determined by an overall height of the grinding pan, an overall height of a gear and an overall height of the columns; and the overall height of the columns is adapted for use for different-sized grinding pans and gears, and represents a directional quantity.

7. The roller mill of claim 6, wherein:

the circumferential foundation frame is located at a lower area of the mill foundation than the gear foundation frame.

8. The roller mill of claim 7, wherein:

the mill foundation separately receives the circumferential foundation frame and the gear foundation frame, and has a mushroom-shaped construction in an area of the gear foundation frame.

9. The roller mill of claim 6, wherein:

the circumferential foundation frame is located at a higher area of the mill foundation than the gear foundation frame.

10. The roller mill of claim 6, wherein:

the circumferential foundation frame is constructed in a higher, rampart-like area of the mill foundation, with an assembly gap as a U-shaped or horseshoe-shaped frame, and has connecting frame parts and corner areas and end parts that are formed by the foundation frames.

11. The roller mill of claim 7, wherein:

the circumferential foundation frame is located at a higher area of the mill foundation than the gear foundation frame.

12. The roller mill of claim 11, wherein:

the circumferential foundation frame is positioned at a higher area of the mill foundation constructed as a rampart.

13. The roller mill of claim 12, wherein:

the circumferential foundation frame is constructed in the higher area of the mill foundation, with an assembly gap as a U-shaped or horseshoe-shaped frame, and has connecting frame parts and corner areas and end parts that are formed by the foundation frames.

14. The roller mill of claim 11, wherein:

the circumferential foundation frame is constructed in a higher, rampart-like area of the mill foundation, with an assembly gap as a U-shaped or horseshoe-shaped frame, and has connecting frame parts and corner areas and end parts that are formed by the foundation frames.

15. The roller mill of claim 5, wherein:

the circumferential foundation frame is located at a lower area of the mill foundation than the gear foundation frame.

16. The roller mill of claim 5, wherein:

the circumferential foundation frame is constructed in a higher, rampart-like area of the mill foundation, with an assembly gap as a U-shaped or horseshoe-shaped frame, and has connecting frame parts and corner areas and end parts that are formed by the foundation frames.

17. The roller mill of claim 16, wherein:

the foundation frames are arranged as end areas and bound the assembly gap, and are detachably connected by supporting crossbeams in an operating state of the roller mill.

18. The roller mill of claim 1, wherein:

the foundation frames are arranged as corner areas and end areas in the circumferential foundation frame and have a rectangular construction in plan view, and include double-T steel girders.

19. The roller mill of claim 1, wherein:

the connecting frame parts include substantially parallel double-T steel girders that are connected with steel girders of the foundation frames.

20. The roller mill of claim 1, wherein:

at least one of the circumferential foundation frame and a gear foundation frame is constructed from annular reinforced concrete.

21. The roller mill of claim 1, wherein:

a torsionally stiff construction of connecting elements is positioned between the columns in an upper area of the columns, close to a rocker axis.

* * * * *